United States Patent [19]

Geyer et al.

[11] Patent Number: 4,998,523

[45] Date of Patent: Mar. 12, 1991

[54] INJECTION TIMING ADJUSTER FOR INTERNAL COMBUSTION ENGINES

[75] Inventors: Gerhard Geyer, Munich; Johann Mendle, Hoerlkofen; Hermann-Josef Dillmann, Riemerling, all of Fed. Rep. of Germany

[73] Assignee: Robert Bosch GmbH, Stuttgart, Fed. Rep. of Germany

[21] Appl. No.: 466,118

[22] Filed: Jan. 16, 1990

[30] Foreign Application Priority Data

Mar. 4, 1989 [DE] Fed. Rep. of Germany ..... 3907026

[51] Int. Cl.[5] ..... F02M 37/04; F02M 59/00

[52] U.S. Cl. ..... 123/502; 123/501; 464/2

[58] Field of Search ..... 123/501, 502, 500; 464/2, 3, 4, 5, 6

[56] References Cited

U.S. PATENT DOCUMENTS

| | | | |
|---|---|---|---|
| 3,650,125 | 9/1972 | Phillips | 464/2 |
| 3,774,411 | 11/1973 | Phillips et al. | 464/2 |
| 4,332,227 | 6/1982 | Bauer | 123/502 |
| 4,401,088 | 8/1983 | Morin | 123/502 |
| 4,476,836 | 10/1984 | Enomoto | 123/501 |
| 4,491,116 | 1/1965 | Morin | 123/501 |
| 4,509,490 | 4/1985 | Morin | 123/501 |
| 4,530,336 | 7/1985 | Ichinose | 123/502 |
| 4,557,239 | 12/1985 | Ohkubo | 123/502 |
| 4,712,530 | 12/1987 | Rapp | 123/502 |

FOREIGN PATENT DOCUMENTS

| | | | |
|---|---|---|---|
| 0188735 | 11/1982 | Japan | 123/502 |
| 0005836 | 1/1984 | Japan | 123/501 |

*Primary Examiner*—Carl S. Miller

*Attorney, Agent, or Firm*—Edwin E. Greigg

[57] ABSTRACT

An injection timing adjuster for internal combustion engines, by which a mutual rotational position of a driven shaft relative to a drive shaft is variable as a function of operating characteristics. The adjuster includes two pairs of cams serving as adjusting mechanisms, the adjusting cams are connected by bolts to intermediate elements, which in turn each are coupled, by one coupling pin, to two each hydraulically actuatable adjusting pistons disposed parallel to one another on one side of the adjuster. The adjusting pistons are guided in a piston holder, which has two lateral limiting faces, which together with two walls offstanding from the intermediate elements form a sliding guide for the intermediate elements. As a result of an improved sliding guidance, the injection timing adjuster can be used for transmitting higher drive outputs than previously in prior art adjusters.

21 Claims, 2 Drawing Sheets

INJECTION TIMING ADJUSTER FOR INTERNAL COMBUSTION ENGINES

BACKGROUND OF THE INVENTION

The invention is based on an injection timing adjuster for internal combustion engines.

An injection timing adjuster of this type is already known from German Patent 33 39 009. Here, via intermediate elements and transmission elements located on them and via an eccentric adjusting mechanism, the reciprocating motion of adjusting pistons guided in a piston holder is converted into a mutual rotation of two coaxial shafts, namely a drive shaft and a driven shaft. Two adjusting pistons at a time are disposed parallel to one another on one side of the adjuster, in a plane at right angles to the longitudinal axis of the adjuster. Coupling pins, each of which protrudes into a transverse bore in one of the adjusting pistons and is firmly joined to one of the intermediate elements, are provided as the transmission elements between the adjusting pistons and the intermediate elements. The longitudinal axes of the coupling pins extend vertically to the longitudinal axis of the adjuster and vertically to the longitudinal axes of the adjusting and the intermediate elements. The longitudinal axes of the coupling pins extend vertically to the longitudinal axis of the adjuster and vertically to the longitudinal axes of the adjusting piston. Because of the eccentric action of the adjusting mechanism, upon an adjustment of the two shafts relative to one another, the piston holder is rotated on its guide portion, and the forces necessary for rotating the piston holder are transmitted to the piston holder both by the coupling pins protruding into the adjusting pistons and by the adjusting pistons themselves. The adjusting pistons are additionally stressed by the resultant shear forces and can seize in their guides in the piston holder and wear down.

Each of the coupling pins protrudes into a central bore of the associated adjusting piston, because it is for instance not possible to connect two parallel adjusting pistons to one common coupling pin; otherwise the adjusting pistons, with their lower edges, would open into slits in the piston holder necessary for the passage of the coupling pins. Accordingly, the coupling pins can be connected to the intermediate elements only at one end, and because of the slight wall thickness of the intermediate elements, only short connecting lengths are possible. The one-ended support of the coupling pins entails the risk that they may bend or become separated from the connecting bore or tilt, which would cause the adjusting pistons to seize. Upon an adjustment, the intermediate elements move radially outward or inward and are radially guided only via the coupling pins and the adjusting pistons. Because of play and hence tilting of the coupling pins in the adjusting pistons, it is possible that the intermediate elements may seize in the course of a radial motion.

OBJECT AND SUMMARY OF THE INVENTION

The injection timing adjuster according to the invention has an advantage over the prior art that the intermediate elements are guided over large surfaces on the piston holder.

Because of the parallel guidance of the intermediate elements directly on the piston holder, the functions of guiding the intermediate elements and of inducing the adjusting forces in the intermediate elements are separate. The forces necessary for rotating the piston holder are transmitted directly to the piston holder via the large contact surfaces between the intermediate elements and the piston holder.

Advantageous features and embodiments of the invention are described hereinafter. In one feature, the bending of the coupling pins is lessened, or a tilted position is precluded, so that seizing of the adjusting pistons in the cylinder bores is prevented. A further feature is that the press fits of the coupling pins in the intermediate elements are not damaged at the outset, in the initial assembly of the coupling pins. Another feature provides for reliable lubrication of the coupling pins, with little loss. By still another feature, simple manufacture of the intermediate elements and simultaneous space-saving disposition of the restoring springs, low oscillation inducement of the overall system, and a low number of components become possible.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
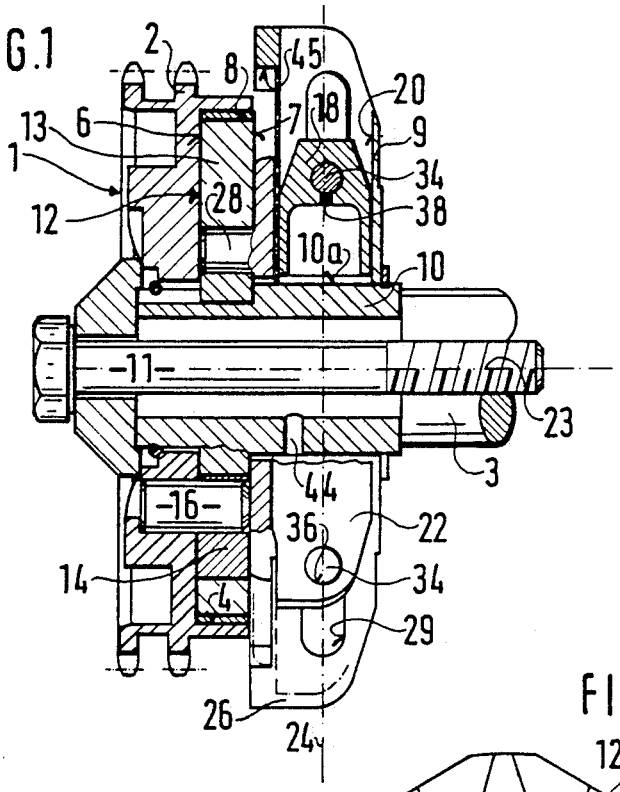
FIG. 1 shows a first exemplary embodiment of an injection timing adjuster in longitudinal section.

The injection timing adjuster 1 shown in FIG. 1 is mounted on a fuel injection pump (not shown) for Diesel engines, as an open injection timing adjuster for installation in a closed drive housing or in the wheel housings of the engine, and so is provided with a gear wheel 2 serving in a known manner as a drive element.

The injection timing adjuster may also be embodied as a closed add-on adjuster. As will be described in further detail below, the injection adjuster serves in a known manner for varying the mutual rotational position of two coaxial shafts, that is, one drive shaft and one driven shaft, as a function of operating characteristics; either the driven shaft is at the camshaft of the injection pump, or it is an intermediate shaft coupled to the camshaft of the injection pump. By varying the rotational position of the two shafts, the instant of injection or the supply onset of the fuel injection pump is varied as a function of a predetermined regularity.

In the first exemplary embodiment shown in FIGS. 1–4, a drive gear wheel 2 serves as the drive shaft and a camshaft 3 of the fuel injection pump serves as the driven shaft. An adjuster disk 8 provided with two plane-parallel side faces 6 and 7 is supported in a machined groove 4 of the drive gear wheel 2; the adjuster disk 8 is embodied as a flangelike part of an adjuster hub 10. The adjuster hub 10 is secured on to the camshaft 3 by means of a tightening screw or bolt 11 and on a guide portion **10*a* receives a piston holder 9. The connection between the drive gear wheel 2 and the adjuster disk 8, which can be considered part of the camshaft 3**, is brought about by means of two pairs 12 of cams rotatably supported in the adjuster disk 8, each pair comprising one adjusting cam 13 and one compensation cam 14. The compensation cams 14 are each connected by means of a respective bolt 16 to the drive gear wheel 2 and serve to compensate for the height of the arc that the center points of the adjusting cams 13 would attain if they rotated about the bolts 16 without any compensating cams 14.

This rotational motion is effected by means of two adjusting pistons 18 guided parallel to one another or in other words in pairs in the piston holder 9 and actuatable by the pressure of a hydraulic medium; in accordance with the pressure of the hydraulic medium, controlled by a control unit, these adjusting pistons are moved outward away from the adjuster hub 10 counter to the force of restoring springs 19, which are guided in an oil-tight manner in outwardly pointing cylinder bores 20, disposed parallel to one another, of the piston holder 9. The adjusting cams 13 are rotated via intermediate elements 22 that engage them eccentrically. The adjusting pistons 18 are all guided within a plane 24, shown in dot-dash lines in FIG. 1, located vertically of a longitudinal axis 23 of the adjuster.

The piston holder 9 has two planar limiting faces 26 extending parallel both to the longitudinal axis 23 of the adjuster and to the longitudinal axes 21 of the cylinder bores 20. Both the limiting faces 26 and partitions 27, disposed between the adjusting pistons 18, are provided with outwardly oriented slots 29 in the vicinity of the cylinder bores 20.

Figure 3:
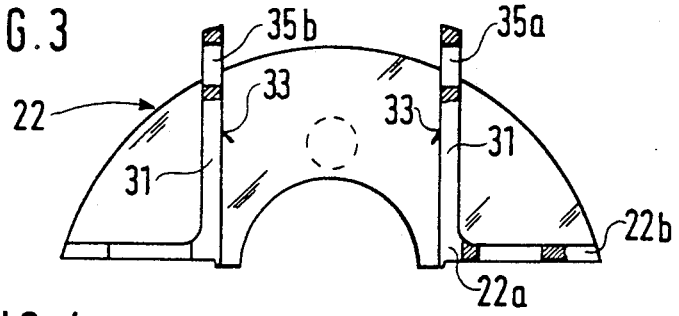
FIG. 3 shows an intermediate element of the injection adjuster in a front view.
Figure 4:
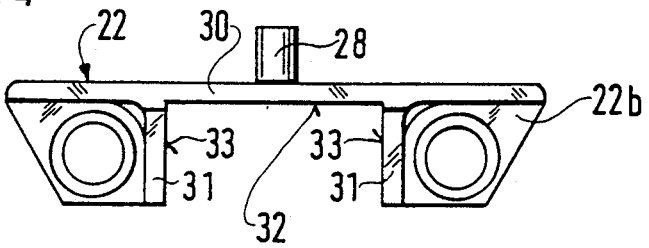
FIG. 4 shows the intermediate element in plan view.

As shown in FIG. 3, each of the intermediate elements 22 comprises a center portion 30, which is embodied in a U shape vertically of the longitudinal axis 23 of the adjuster. Two walls 31 are offstanding vertically of the center portion 30, extending parallel to the limiting faces 26 and being oriented toward the piston holder 9. In the vicinity of the cylinder bores 20, the piston holder 9 is encompassed in a U shape by the walls 31 and center portion 30 of the intermediate elements 22. A plane face 32 on the center portion 30 and two guide faces 33, facing one another, on the walls 31 of the intermediate elements 22 form a sliding guide for the intermediate elements 22. Two adjusting pistons 18 at a time, disposed parallel to one another on one side of the adjuster, are connected via a single, common coupling pin 34 to one of the intermediate elements 22. One integrally formed-on pin 28 protrudes from the side of the center portions 30 remote from the piston holder 9 and engages one of the adjusting cams 13.

The coupling pins 34 are forced into bores 35*a*, *b* in the walls 31 of the intermediate elements 22; they can pass through the slots 29 in the limiting faces 26 and partitions 27 through the piston holder 9 and are received by transverse bores 36 in the adjusting pistons 18. The coupling pins 34 extend at right angles to the longitudinal axis 23 of the adjuster and at right angles to the longitudinal axes 21 of the cylinder bores 20. On their forward end 34*a* with which they were initially introduced in assembly, the coupling pins 34 are provided with a somewhat smaller diameter than on their rearward end 34*b*. Correspondingly, the bores 35*b* through which the coupling pins 34 are introduced first are somewhat larger in their diameter than the opposed bores 35*a*. The different diameters prevent the fit of the bore 35*b* from already being destroyed upon assembly of the coupling pins 34.

The adjusting pistons 18 are embodied as hollow pistons, and the transverse bores 36 for the passage of the coupling pin 34 each communicate via a respective bore 38 with the interiors of the adjusting pistons 18 and thus with the regions acted upon by pressure of the cylinder bores 20 below the adjusting pins 18.

Four compression springs 19, engaging brackets 22*b* on the facing ends 22*a* of the intermediate elements 22 serve a restoring springs and act in both a restoring and a stabilizing manner. The compression springs 19 are fastened in place between spring supports 39 and 40. The spring supports 39 are embodied as spring washers and are each secured to the ends of a respective freely swinging guide bolt 42 that keeps the compression springs 19 compressed. The spring supports 40 are received by the brackets 22*b*, which protrude at right angles and are bored through, of the intermediate elements 22 and are likewise embodied as sleevelike spring washers. The hydraulic medium is supplied to the cylinder bores 20 under the adjusting pistons 18 through the bores 44 in the adjuster hub 10.

Figure 2:
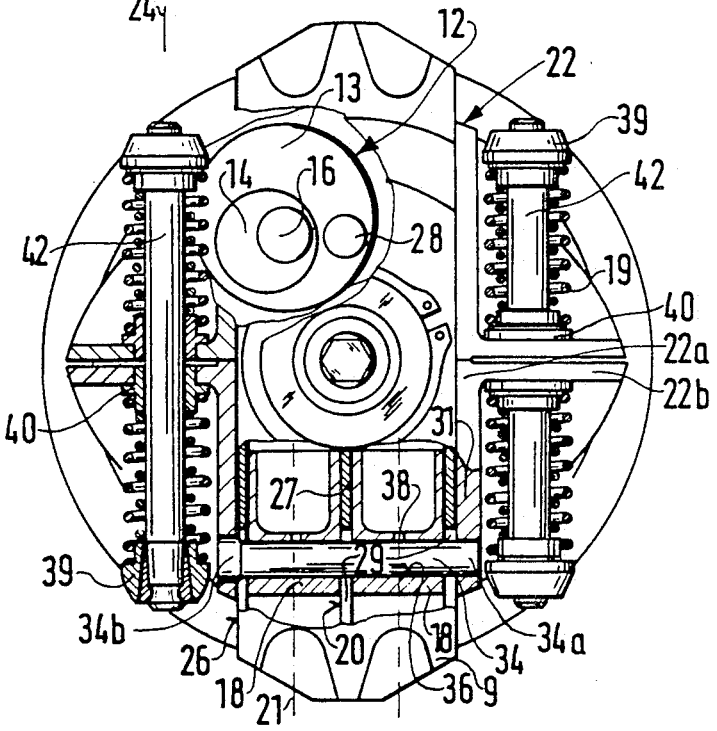
FIG. 2 shows the injection adjuster in a cross section.

In the outset position of the adjusting pistons 18 shown in FIGS. 1 and 2, the drive gear wheel 2 assumes a predetermined rotational position with respect to the adjuster hub 10. With their ends 22*a*, the intermediate elements 22 are braced against one another with their ends 22*a* by the biasing force of the restoring springs 19; as a result the outset position is defined. An adjusting motion of the adjusting pistons 18 is transmitted via the coupling pins 34 to the intermediate elements 22, and by them via the formed-on pins 28 to the adjusting cams 13. In this process, carried by the piston holder 9, the intermediate elements 22 move radially outward or inward and at the same time execute a rotational motion about the longitudinal axis 23 of the adjuster. The piston holder 9 is carried along via the guide faces 33 and follows along with the rotational motion of the intermediate elements 22. The longest possible stroke of the adjusting pistons 18, and hence the maximum adjustment of the mutual rotational position between the drive gear wheel 2 and the adjuster hub 10, is limited by two stops 45 on the piston holder 9, against which the center portions 30 of the intermediate elements 22 abut upon attaining their outermost terminal position.

The intermediate elements 22 are radially guided securely and exactly by the piston holder 9, via the large guide faces 33 and limiting faces 26. As a result, seizing of the intermediate elements 22 upon radial motion on the guide bolts 42 is avoided. Shear forces, both those exerted on the piston holder 9 by the intermediate elements 22 in their rotation and those resulting at the piston holder 9 from rotary vibration, are likewise transmitted via the large guide faces 33 and limiting faces 26, resulting in low pressures per unit of surface area and a long service life of the adjuster. By means of the coupling pins 34, each of which is connected to two of the adjusting pins 18 and is forced into both walls 31 each of one intermediate element 22, an exact guidance of the adjusting pistons 18 in the cylinder bores 20 is attained, because the coupling pins 34 can bend only slightly and therefore cannot tilt the adjusting pistons 18 and cause them to seize. Purposeful lubrication of the coupling pins 34, with little loss, is attained via the bores 38 in the adjusting pistons 18.

Figure 5:
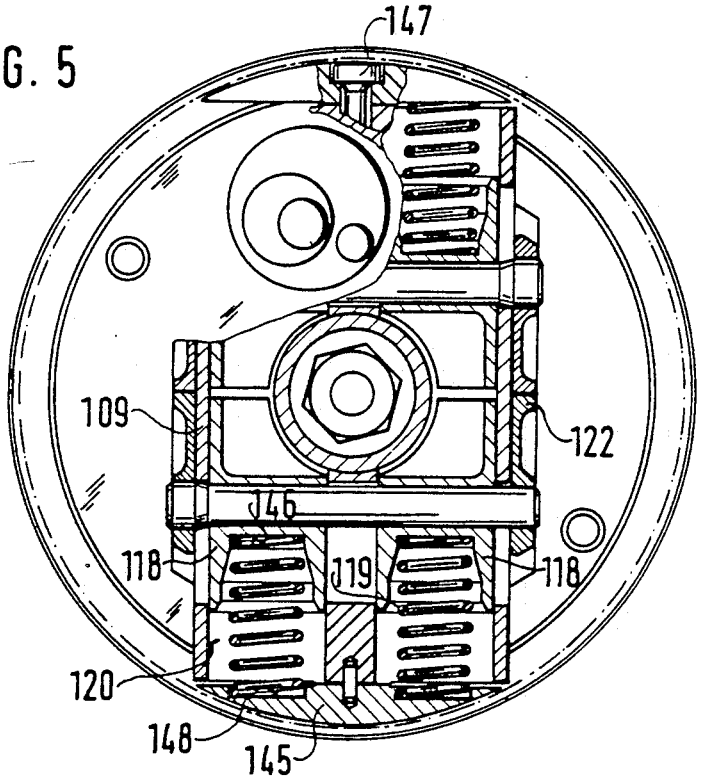
FIG. 5 shows a second exemplary embodiment of the injection adjuster in cross section.

In a second exemplary embodiment shown in FIG. 5, the cylinder bores 120 in the piston holder 109, differing from the first exemplary embodiment, are covered toWard the outside, each by one cap element 145 serving as a spring yoke. Between each adjusting piston 118 and the spring yoke 145 is one compression spring, acting as a restoring spring 119. The compression springs are guided in indentations 146 on the end face of the adjusting pistons 118 and in countersunk areas 148 in the spring yoke 145. The spring yoke 145 is connected to the piston holder 109 via two screws 147.

As a result of the disposition of the restoring springs 119 inside the piston holder 109, the spring supports on the intermediate elements 122 can be omitted, making for simpler production of the intermediate elements, and leaving space beside the piston holder 109 for the installation of other devices, for example for adjusting the supply onset of the fuel injection pump.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A rotating injection timing adjuster for internal combustion engines such as Diesel engines comprising a drive means (2) and a driven shaft (3), adjusting pistons (18) accommodated inside the rotating adjuster and actuatable counter to a restoring force by a pressure of a hydraulic medium, which pressure is controlled as a function of operating characteristics, the adjusting pistons being guided in outward-pointing cylinder bores (20) of a piston holder (9) disposed on a hub element (10) of said driven shaft (3), and a mutual rotational position of said drive means (2) and said driven shaft (3) is variable, by means of said adjusting pistons and by means of intermediate elements (22) and transmission elements attached to said intermediate elements, via a cam adjustment mechanism (12) that connects said drive means (2) to said driven shaft (3), wherein coupling elements (34) connected to the intermediate elements and said adjusting pistons (18) and disposed at right angles to the longitudinal axes (21) of the cylinder bores (20) serve as transmission elements for transmitting an adjusting motion of the adjusting pistons (18) to the intermediate elements (22), pins (28) attached to the intermediate elements (22) engage the cam adjusting mechanism (12) and serve as transmission elements between the intermediate elements (22) and the cam adjustment mechanism (12), said piston holder (9) includes limiting faces (26) extending parallel to the longitudinal axis (23) of the adjuster and parallel to the longitudinal axes (21) of the cylinder bores (20), and the intermediate elements (22) encompass the piston holder (9) in a U-shape on its limiting faces (26) and one end face and as a result are radially guided on the piston holder (9).

2. An injection timing adjuster as defined by claim 1, in which said intermediate elements (22) are embodied as U-shaped at right angles to the longitudinal axis (23) of the adjuster and substantially comprise a center portion (30) and walls (31) protruding vertically away from the center portion toward the piston holder (9) and parallel to the limiting faces (26) of the piston holder.

3. An injection timing adjuster as defined by claim 1, in which two adjusting pistons (18) on each side of the adjuster are disposed parallel to one another, and coupling pins 34 are used as coupling elements between the adjusting pistons (18) and the intermediate elements (22), said coupling pins (34) extend vertically to the longitudinal axis (23) of the adjuster and vertically to the longitudinal axes (21) of the cylinder bores (20) and said two adjusting pistons (18) disposed on each side of the adjuster are connected via a single, common coupling pin to one of the intermediate elements (22).

4. An injection timing adjuster as defined by claim 2, in which two adjusting pistons (18) on each side of the adjuster are disposed parallel to one another, and coupling pins 34 are used as coupling elements between the adjusting pistons (18) and the intermediate elements (22), said coupling pins (34) extend vertically to the longitudinal axis (23) of the adjuster and vertically to the longitudinal axes (21) of the cylinder bores (20) and said two adjusting pistons (18) disposed on each side of the adjuster are connected via a single, common coupling pin to one of the intermediate elements (22).

5. An injection timing adjuster as defined by claim 3, in which said coupling pins (34) are forced into bores (35*a, b*) of walls (31) and have a smaller diameter on their forward end (34*a*), which is introduced first upon assembly, than at their rearward end (34*b*).

6. An injection timing adjuster as defined by claim 4, in which said coupling pins (34) are forced into bores (35*a, b*) of walls (31) and have a smaller diameter on their forward end (34*a*), which is introduced first upon assembly, than at their rearward end (34*b*).

7. An injection timing adjuster as defined by claim 3, in which said adjusting pistons (18) have transverse bores (36) for passage of said coupling pins (34), which bores communicate via openings (38) in the adjusting pistons (18) with a region acted upon by pressure of the cylinder bores (20) between the adjusting pistons (18).

8. An injection timing adjuster as defined by claim 4, in which said adjusting pistons (18) have transverse bores (36) for passage of said coupling pins (34), which bores communicate via openings (38) in the adjusting pistons (18) with a region acted upon by pressure of the cylinder bores (20) between the adjusting pistons (18).

9. An injection timing adjuster as defined by claim 1, in which one cap element each is disposed above the cylinder bores in the piston holder, toward the outside, and one restoring spring (119) is fastened in place between each adjusting piston and the cap element.

10. An injection timing adjuster as defined by claim 2, in which one cap element each is disposed above the cylinder bores in the piston holder, toward the outside, and one restoring spring (119) is fastened in place between each adjusting piston and the cap element.

11. An injection timing adjuster as defined by claim 3, in which one cap element each is disposed above the cylinder bores in the piston holder, toward the outside, and one restoring spring (119) is fastened in place between each adjusting piston and the cap element.

12. An injection timing adjuster as defined by claim 5, in which one cap element each is disposed above the cylinder bores in the piston holder, toward the outside, and one restoring spring (119) is fastened in place between each adjusting piston and the cap element.

13. An injection timing adjuster as defined by claim 7, in which one cap element each is disposed above the cylinder bores in the piston holder, toward the outside, and one restoring spring (119) is fastened in place between each adjusting piston and the cap element.

14. An injection timing adjuster as defined by claim 1, which includes restoring springs for bringing to bear a restoring force for the adjusting pistons, in which on their ends (22*a*) facing one another, said intermediate elements (22) have brackets (22*b*) offstanding at right angles from their walls (31) and each receives one spring support (40) for the restoring springs (19).

15. An injection timing adjuster as defined by claim 2, which includes restoring springs for bringing to bear a restoring force for the adjusting pistons, in which on their ends (22*a*) facing one another, said intermediate elements (22) have brackets (22*b*) offstanding at right angles from their walls (31) and each receives one spring support (40) for the restoring springs (19).

16. An injection timing adjuster as defined by claim 3, which includes restoring springs for bringing to bear a restoring force for the adjusting pistons, in which on their ends (22*a*) facing one another, said intermediate elements (22) have brackets (22*b*) offstanding at right angles from their walls (31) and each receives one spring support (40) for the restoring springs (19).

17. An injection timing adjuster as defined by claim 4, which includes restoring springs for bringing to bear a restoring force for the adjusting pistons, in which on their ends (22*a*) facing one another, said intermediate elements (22) have brackets (22*b*) offstanding at right angles from their walls (31) and each receives one spring support (40) for the restoring springs (19).

18. An injection timing adjuster as defined by claim 5, which includes restoring springs for bringing to bear a restoring force for the adjusting pistons, in which on their ends (22*a*) facing one another, said intermediate elements (22) have brackets (22*b*) offstanding at right angles from their walls (31) and each receives one spring support (40) for the restoring springs (19).

19. An injection timing adjuster as defined by claim 6, which includes restoring springs for bringing to bear a restoring force for the adjusting pistons, in which on their ends (22*a*) facing one another, said intermediate elements (22) have brackets (22*b*) offstanding at right angles from their walls (31) and each receives one spring support (40) for the restoring springs (19).

20. An injection timing adjuster as defined by claim 7, which includes restoring springs for bringing to bear a restoring force for the adjusting pistons, in which on their ends (22*a*) facing one another, said intermediate elements (22) have brackets (22*b*) offstanding at right angles from their walls (31) and each receives one spring support (40) for the restoring springs (19).

21. An injection timing adjuster as defined by claim 8, which includes restoring springs for bringing to bear a restoring force for the adjusting pistons, in which on their ends (22*a*) facing one another, said intermediate elements (22) have brackets (22*b*) offstanding at right angles from their walls (31) and each receives one spring support (40) for the restoring springs (19).

* * * * *